United States Patent [19]

Rollins

[11] 4,090,309

[45] May 23, 1978

[54] FILTER DRYING APPARATUS

[76] Inventor: James E. Rollins, 2150 Poplar Ridge Rd., Pasadena, Md. 21122

[21] Appl. No.: 758,820

[22] Filed: Jan. 12, 1977

[51] Int. Cl.[2] ..... F26B 19/00

[52] U.S. Cl. ..... 34/58; 15/304; 134/153; 134/157

[58] Field of Search ..... 34/8, 58, 104; 15/304; 134/153, 157

[56] References Cited

U.S. PATENT DOCUMENTS

| | | | |
|---|---|---|---|
| 2,104,456 | 1/1938 | Friedman | 34/58 |
| 2,416,475 | 2/1947 | Friedman | 34/58 |
| 3,998,656 | 12/1976 | Grotto | 34/58 |
| 4,016,828 | 4/1977 | Mahter, Jr. et al. | 34/58 |

*Primary Examiner*—Kenneth W. Sprague
*Assistant Examiner*—James C. Yeung
*Attorney, Agent, or Firm*—J. Wesley Everett

[57] ABSTRACT

A filter drying apparatus for cylindrical-type filter units having a frame and an adjustable means for rotating the filter unit at regulated set speeds, the area in which the filter is rotated being surrounded by a casing. Within the casing, adjacent the bottom thereof, is a freely rotatable lower cone-shaped member for supporting one end of the filter, and directly above the lower cone is a similar vertically adjustable cone-shaped member connected with the filter rotating means. These cone-shaped members are adapted to engage the filter unit, one at each end thereof, the cones being tapered at an angle of approximately 60°, and constructed of a semi-elastic material such as rubber, or a suitable plastic composition. Both cone members are tapered outwardly and downwardly from their tops, the lower cone member engaging the inner edge of the filter unit, and the upper cone member engaging the outer edge of the opposite end of the filter unit to rotate the same.

3 Claims, 5 Drawing Figures

FILTER DRYING APPARATUS

The invention relates to an improved apparatus for drying cylindrical-type filter units, particularly after the unit has been through a washing cycle.

These cylindrical type filter units are one of the general types used in various filter operations particularly on the air intake manifold of internal combustion engines wherein the collection of dust particles retards the passage of air therethrough and in turn decreases the efficiency of the engine. However, regardless of their use, the filter units are usually cleaned by washing and then dried, the drying taking up the major part of the cleaning period; therefore, the use of the present apparatus not only reduces the drying time, but provides for a more uniform drying of and minimum handling of the filter.

The primary object of the invention is to provide a drying apparatus having adjustable means for drying various size cylindrical filter units.

Another object of the invention is to provide a simplified compact assembly that may be made up into a single unit.

While several objects of the invention have been noted, other objects, uses and advantages will become apparent as the nature of the invention is more fully disclosed in the following description with reference to the accompanying drawings wherein.

Figure 2:
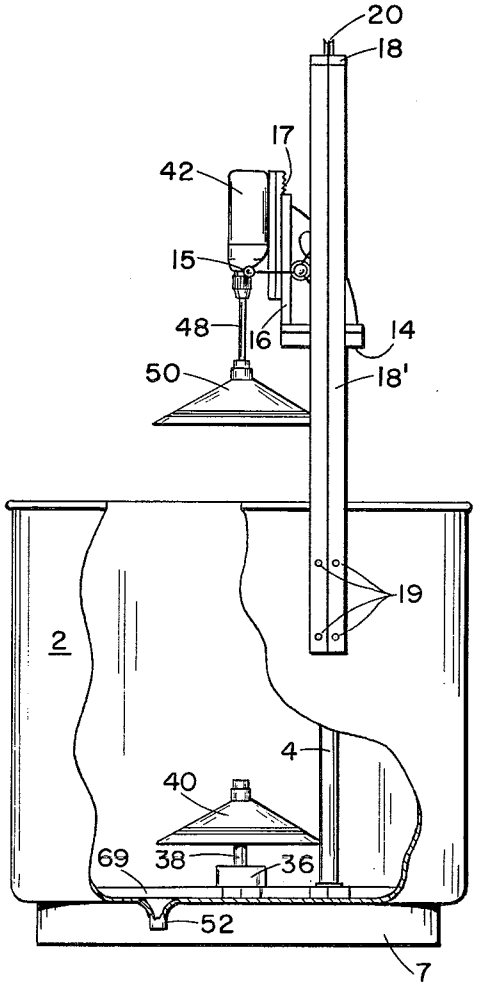
FIG. 2 is a side elevational view of the apparatus partly in elevation and partly in section.
Figure 1:
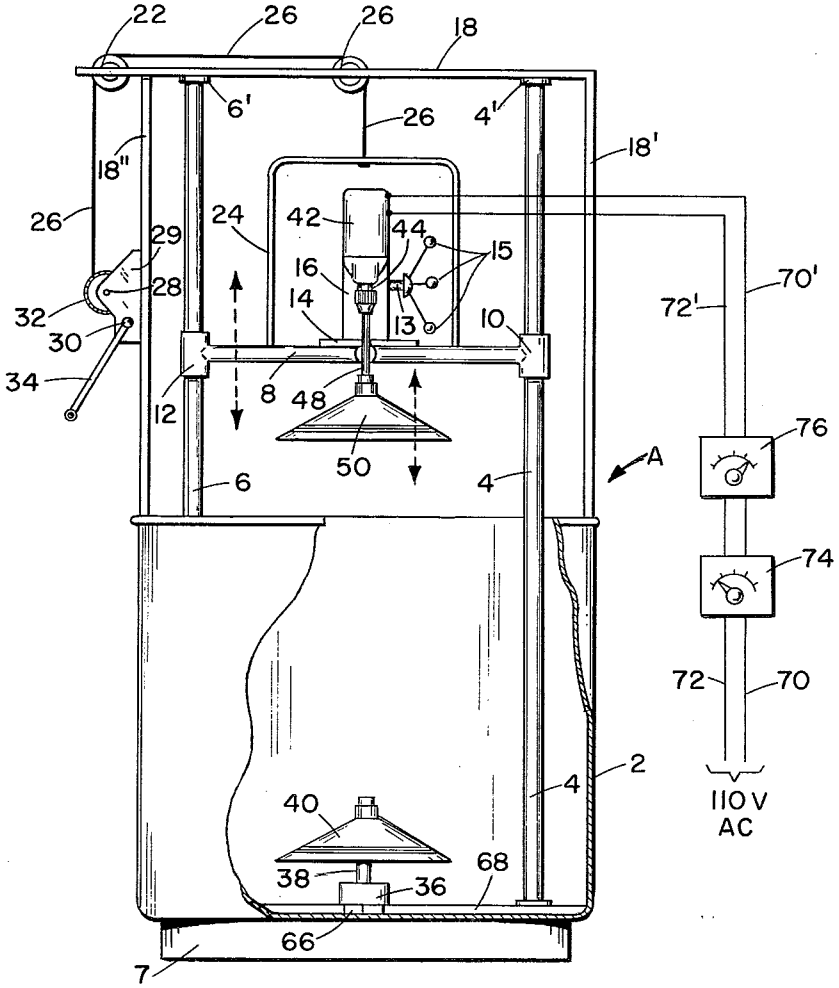
FIG. 1 is a front elevational view of the apparatus partly in elevation and partly in section.

Referring in particular to the drawings, A represents the drier unit as a whole, having a casing 2 and a frame comprising at least two upright members 4 and 6 and a horizontal cross-bar member 8 slideably mounted between the two upright members 4 and 6. The cross-bar member 8 is provided with elongated end pieces 10 and 12 rigidly fixed to the ends of the cross-bar 8 having channels perpendicular to the axis of the cross-bar adapted to slideably engage the vertical members 4 and 6 to keep the cross-bar perpendicular with the frame members 4 and 6. The casing 2 and the vertical frame members 4 and 6 are fixed to a base member 7.

Fixed to the cross-bar 8 is a horizontal plate member 14 supporting a vertical member 16 which in turn supports means for rotating the filter unit.

Supported above and upon the upper ends 4' and 6' of the two upright members 4 and 6 is a horizontal support 18. Extending downwardly from each end of the member 18 are leg members 18' and 18'' secured to the casing 2 by any suitable means 19. The horizontal member 18 is provided with a pulley 22 adjacent the outer end thereof, which will be later referred to.

There is attached to the cross-bar 8 a fixed looped member 24 having attached thereto a cable 26 which extends upwardly and over pulleys 20 and 22 and downwardly about a shaft 28 rotatably supported within a bracket 29 about which the cable 26 is wound. Fixed to the shaft 28 is a ratchet wheel and pawl (not shown) for holding the shaft 28 in a selected stationary position.

For rotating the shaft 28 there is a handle 34 mounted on a shaft 30 having a pinion wheel adapted to engage the wheel 32 for rotating the shaft 28 for raising and lowering the cross-bar 8.

Figure 5:
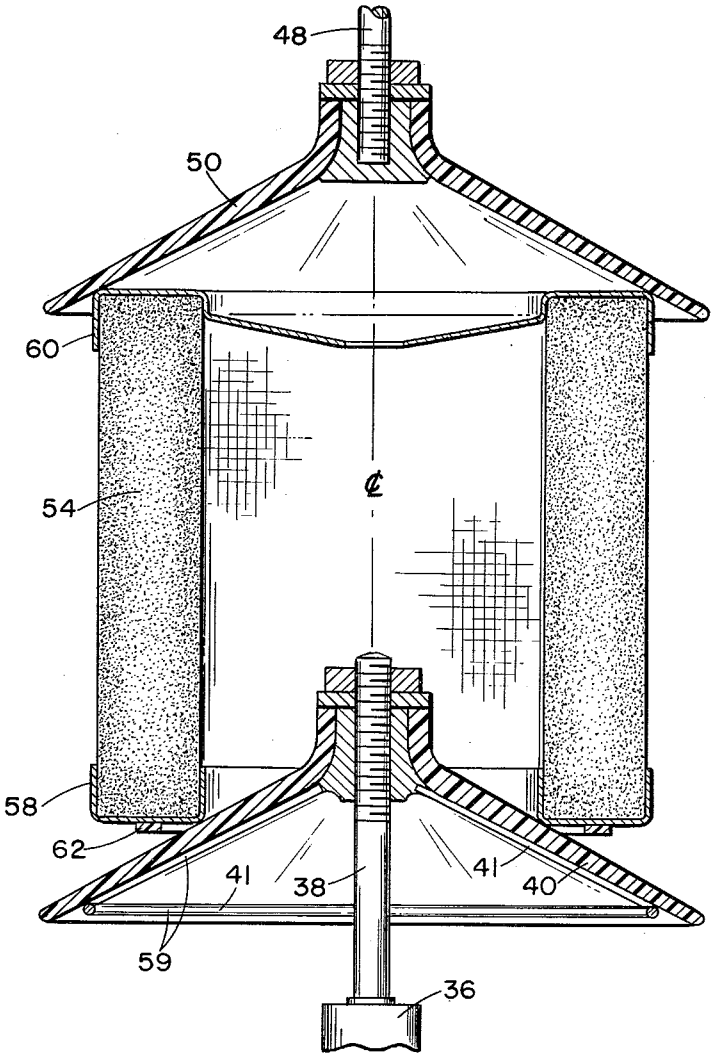
FIG. 5 is an enlarged sectional view of a filter in position within the apparatus to be dried, including sectional view of the holding elements.
Figure 3:
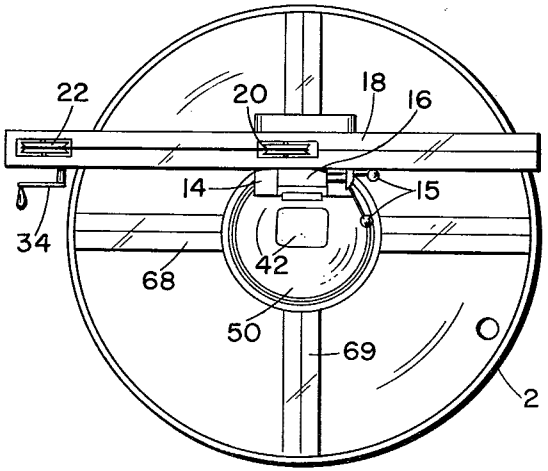
FIG. 3 is a top plan view of the same.

Secured substantially at the center and adjacent the bottom of the casing 2 is a bearing 36 supporting a vertical spindle 38. Mounted on the upper end of the spindle 38 is a cone-shaped member 40. This cone-shaped member is constructed of one of the semi-elastic materials, such as rubber or one of the suitable plastics, and is tapered from its top downwardly and outwardly at an angle of substantially 60°. This cone is freely rotatable and is adapted to support the lower end of the filter unit, as shown in FIG. 5. The lower cone 40 may be reinforced about its bottom by more rigid members 59 to help support the weight of the filter.

Supported on the member 16 is a motor 42, preferably electrically operated, having a vertical drive shaft 44 in a vertical plane with the shaft 48 supporting the upper cone 50. However, the motor may be supported on the cross-bar 8 in any convenient manner. The preferred manner of supporting the motor 42 is to fix to the motor a toothed rack 17 and a pinion (not shown) fixed to the shaft 13 which may be rotated by the handles 15 for making small vertical adjustments to the motor.

The vertical drive shaft 44 of the motor is connected with a spindle 48 which in turn supports an upper cone member 50. As previously stated, the spindles 38 and 48 are in vertical alignment supporting the cones 40 and 50 respectively.

The casing is of water-tight construction and is provided with an outlet 52 in the bottom thereof for draining off the water accumulated from the drying process. This casing surrounds the lower area of the distance between the two cone members which is the area in which the filter is rotated.

Figure 4:
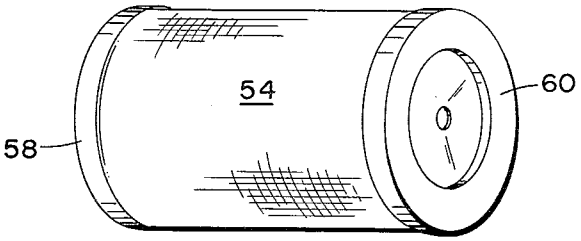
FIG. 4 is a perspective view of a typical cylindrical type filter.

The filter unit for which the drying assembly is constructed is of the cylindrical type as shown best at 54 in FIG. 4. The filter itself is generally reinforced about its bottom and top edges by a separate member of a more rigid material, such as shown at 58 and 60, and possibly a gasket 62 adjacent the bottom surface of the lower member 58.

It will be noted that the inner edge of the lower reinforcing element 58 engages the upper surface of the lower cone 40, and the inner surface of the upper cone 50 engages the outer edge of the upper reinforced member 60. Both cones are tapered outwardly and downwardly at an angle of approximately 60°. These cones will take a large number of differdiameter sizes as well as different lengths of cones, which will be later referred to.

Extending across the bottom of the casing 2 are reinforcing members 68 and 69 for supporting the bearing 36 which in turn supports the lower end of the spindle 38 and the cone 40.

The electrical current for operating the motor 42 is supplied through wires 70 and 72. The electric current passes through a conventional timer 74 controlling the time of the drying operation, and a conventional speed control 76 for controlling the speed of the motor for different speeds of the drying operation, whereby the electric current passes from the speed control to the motor through wires 70' and 72'.

The speed of the motor may be either automatically or manually controlled.

In operation, the rotating mechanism, positioned on the cross-bar 8, is raised by means of the crank handle 34 and the cable 26 for clearance to insert the filter unit 54 into the casing 2. One end of the filter unit is placed on the cone 40 after which the upper cone 50 is lowered to a point adjacent the upper end of the filter unit by the crank handle 34. If there are any minor vertical adjustments that need to be made when the unit is substantially in place, they are made by the handles 15 as previously described. The motor 42 is operated first at a slow speed to spin out a portion of the heavy-laden water within the filter by centrifugal force and then the speed of the rotation is gradually increased to a final predetermined rate to extract the remaining water. The apparatus is operated in substantially the same manner in subsequent filter drying operations.

While the apparatus is shown of a particular construction, it is not intended to be limited thereto as the scope of the invention is best defined in the appended claims.

What is claimed is:

1. A centrifugal drying apparatus for spinning cylindrical filter units for dispensing moisture therefrom, comprising in combination:

a. a base;

b. a frame supported upwardly from the said base and comprising at least two spaced vertical standards;

c. a cross bar extending substantially horizontally between the spaced frame members having means at each end thereof for slideably engaging the said standards;

d. said frame extending upwardly and terminating in a substantially horizontal plane above the plane of the cross bar;

e. means for adjustably supporting the cross bar at predetermined levels along the frame members comprising a movable cable having one end thereof fixed centrally of the cross bar;

f. the opposite end of the said cable extending upwardly and over one or more pully means to a point adjacent one side of the apparatus, said opposite end of said cable having means for moving said cable in opposite directions, and means for temporarily locking said cable at selected positions;

g. means fixed substantially centrally of said cross bar for spinning and supporting an upper cone member, said cone member being formed in an outwardly and downwardly direction adapted to engage the outer rim of the cylindrical filter unit;

h. a lower cone shaped member positioned adjacent the base extending downwardly and outwardly and in alignment with the said upper cone element adapted to receive the opposite end of the cylindrical filter unit and a casing extending outwardly from the said cones and completely about the area between the two cone members.

2. In a centrifugal drier as claimed in claim 1 wherein the cone-shaped elements are constructed of a semi-elastic material.

3. In a centrifugal drier as claimed in claim 1 wherein the cone-shaped filter engaging elements are tapered outwardly and downwardly from their upper ends at an angle of approximately 60°.

* * * * *